US009815100B2

(12) United States Patent
Weinzierl

(10) Patent No.: US 9,815,100 B2
(45) Date of Patent: Nov. 14, 2017

(54) METHOD FOR CONTROLLING A HOT STRIP ROLLING LINE

(75) Inventor: Klaus Weinzierl, Nürnberg (DE)

(73) Assignee: PRIMETALS TECHNOLOGIES GERMANY GMBH, Erlangen (DE)

( * ) Notice: Subject to any disclaimer, the term of this patent is extended or adjusted under 35 U.S.C. 154(b) by 329 days.

(21) Appl. No.: 14/129,650

(22) PCT Filed: Jun. 6, 2012

(86) PCT No.: PCT/EP2012/060738

§ 371 (c)(1),
(2), (4) Date: Apr. 18, 2014

(87) PCT Pub. No.: WO2013/000677

PCT Pub. Date: Jan. 3, 2013

(65) Prior Publication Data

US 2014/0230511 A1 Aug. 21, 2014

(30) Foreign Application Priority Data

Jun. 27, 2011 (EP) ..... 11171512

(51) Int. Cl.
*B21B 37/74* (2006.01)
*B21B 38/00* (2006.01)

(52) U.S. Cl.
CPC ..... *B21B 37/74* (2013.01); *B21B 38/006* (2013.01)

(58) Field of Classification Search
CPC ..... B21B 37/74; B21B 38/006; C21D 9/573; C21D 11/005
See application file for complete search history.

(56) References Cited

U.S. PATENT DOCUMENTS 7,197,802 B2 4/2007 Kurz et al.
8,935,945 B2 * 1/2015 Shimoda ..... B21B 37/74 72/12.2
2006/0225474 A1 * 10/2006 Reinschke ..... B21B 37/74 72/8.5

FOREIGN PATENT DOCUMENTS

CN 1425076 6/2003
CN 101056721 10/2007
(Continued)

OTHER PUBLICATIONS

English language International Search Report for PCT/EP2012/060738, dated Oct. 31, 2012, 2 pages.
(Continued)

*Primary Examiner* — Debra Sullivan
(74) *Attorney, Agent, or Firm* — Staas & Halsey LLP

(57) ABSTRACT

A flat rolling stock of metal passes through roll stands of a finishing train, and a cooling section, in succession. Initial values which characterize the energy content of rolling stock points are determined, at the latest, when said rolling stock points enters into the finishing train. The rolling stock is tracked as it passes through the finishing train and cooling section. The initial values, trackings, and energy content influences are used to determine expected values for the energy content of the rolling stock. The energy content expected for a predetermined location, which lies between the first roll stand and the first cooling device of the cooling section is ascertained and used to determine a target energy content progression, from the predetermined location until the rolling stock passes out of the cooling section. The cooling devices are controlled based on the target energy content progression.

12 Claims, 4 Drawing Sheets

(56) References Cited

FOREIGN PATENT DOCUMENTS

| | | |
|---|---|---|
| DE | 10156008 | 6/2003 |
| EP | 1397523 | 8/2007 |
| EP | 2301685 | 3/2011 |
| EP | 11171512.4 | 6/2011 |
| WO | 2005/076092 | 8/2005 |
| WO | PCT/EP2012/060738 | 6/2012 |

OTHER PUBLICATIONS

European Office Action for European Priority Patent Application No. 11171512.4, dated Nov. 14, 2011, 6 pages.
Chinese Office Action for related Chinese Patent Application No. 2012800317580, dated Nov. 27, 2014, 14 pages.

* cited by examiner

METHOD FOR CONTROLLING A HOT STRIP ROLLING LINE

CROSS REFERENCE TO RELATED APPLICATIONS

This application is based on and hereby claims priority to International Application No. PCT/EP2012/060738 filed on Jun. 6, 2012 and European Application No. 11171512.4 filed on Jun. 27, 2011, the contents of which are hereby incorporated by reference.

BACKGROUND

A control method for controlling a hot strip rolling line,
- wherein the hot strip rolling line comprises a finishing train for rolling flat rolling stock made of metal,
- wherein the finishing train has a plurality of roll stands, through which the flat rolling stock passes in succession in a direction of passage,
- wherein the hot strip rolling line comprises a cooling section disposed downstream of the finishing train,
- wherein an initial value characterizing the energy content of the respective rolling stock point is determined for rolling stock points of the flat rolling stock at the latest when the respective rolling stock point enters the finishing train,
- wherein the initial values are fed to a model for the hot strip rolling line,
- wherein the rolling stock points are tracked as they pass through the finishing train and the cooling section,
- wherein the trackings and energy content influences, to which the rolling stock points are subject in the finishing train and the cooling section, are also fed to the model,
- wherein the control computer uses the model to determine expected values for the rolling stock points characterizing the current energy content of the rolling stock points passing through the hot strip rolling line continuously and in real time based on the initial values, the trackings and the energy content influences as the rolling stock points pass through the hot strip rolling line.

Such subject matter is generally known. Reference is made purely by way of example to DE 101 56 008 A1 and the corresponding U.S. Pat. No. 7,197,802 B2.

A similar disclosure content is known from EP 2 301 685 A1. In EP 2 301 685 A1 the temperature of the corresponding rolling point can be detected by a measuring device to determine the initial value characterizing the energy content of the respective rolling point. The temperature progression over the thickness of the rolling stock can be determined by way of a model. A target energy content progression can also be determined and is taken into account when determining the energy content influences, to which the respective rolling stock point is subject.

The known control method operates very effectively when relatively thin strip material is rolled, so that all the roll stands of the finishing train engage, in other words roll the flat rolling stock (generally strip).

Relatively thick strip (known as tubular stock) with final rolling thicknesses of approx. 5 mm to approx. 30 mm is also rolled in finishing trains and the downstream cooling section. In this case rolling to the final rolling thickness must take place in a roll stand of the finishing train, which is not the last roll stand of the finishing train, for example the penultimate or third to last roll stand of the finishing train.

The flat rolling stock passes through the following roll stands, in other words according to the example the last roll stand or the last and penultimate roll stands, without being rolled.

For the production of tubular stock it is necessary, in order to achieve favorable material properties—in particular high levels of viscosity and strength even at low ambient temperatures—to start cooling as early as possible and to cool quickly. If the flat rolling stock only starts to be cooled when it enters the cooling section disposed downstream of the finishing train, a relatively long time elapses between the end of rolling and the start of cooling. This has a negative influence on the achievable material properties of the flat rolling stock.

For this reason in the related art tubular stock is usually rolled in reversing mills. Reversing mills only have one roll stand, sometimes also two. The flat rolling stock is rolled in a reversing manner in the reversing mill. Cooling starts immediately after the last rolling pass.

If the finishing train has inter-stand cooling facilities, it is possible to start cooling the flat rolling stock immediately after the last rolling pass, so that in principle high quality tubular stock can also be produced in a multi-stand hot strip rolling line. Attempts have recently been made to do this. However in practice the following problem arises:

In the related art the temperature of the flat rolling stock is measured between the finishing train and the cooling section at a temperature measuring point. The measured temperature value is used to determine a—temporal or spatial—target energy content progression for the corresponding rolling stock point. The target energy content progression is used to determine the energy influences to which the corresponding rolling stock point is subject in the cooling section. However the intensive cooling by the inter-stand cooling facilities means that the surface of the flat rolling stock is cooled significantly. After the relevant inter-stand cooling facility the heat must be transferred back to the surface of the flat rolling stock by heat conduction from its interior. The relatively large thickness of the flat rolling stock means that this takes a relatively long time. The temperature state in the flat rolling stock is therefore not yet equilibrium at the temperature measuring point downstream of the finishing train. The temperature measurement downstream of the finishing train is therefore not usable. This has a negative influence on the accuracy with which the reeling temperature downstream of the cooling section can be set and maintained.

It may be possible to apply an offset to the measured temperature measurement value and thus achieve a roughly correct target energy content progression but this procedure is associated with considerable uncertainty and inaccuracy.

SUMMARY

One potential object is to create possibilities for allowing a high level of material quality to be produced in a multi-stand finishing train with downstream cooling section, without requiring a measured final rolling temperature. In particular it should be possible to provide a start value for the cooling section reliably, even if a temperature measurement downstream of the finishing train cannot be used, for example because the cooling process is started upstream of the last roll stand.

The inventors propose a control method of the type mentioned in the introduction in that

- a target energy content progression from a predetermined location until the rolling stock point passes out of the cooling section is determined for the respective rolling stock point using the energy content expected for it at the predetermined location, the predetermined location is located between the first roll stand and the first cooling facility of the cooling section in the direction of passage, the energy content influences, to which the rolling stock points are subject from the predetermined location until the respective rolling stock point passes out of the cooling section, are determined as a function of the determined target energy content progression and the cooling facilities disposed downstream of the predetermined location in the direction of passage are activated according to the determined energy content influences.

The proposed method is therefore based on the knowledge that—if the energy content of the rolling stock points is modeled correspondingly well—the corresponding expected value can be used as at least an equivalent replacement for the measurement of the final rolling temperature and the target energy content progression can be determined based on this—purely mathematically determined—expected value.

The procedure is primarily advantageous when the flat rolling stock is rolled to a final rolling thickness in the roll stand disposed directly upstream of the predetermined location in the direction of passage and is not rolled any more after the predetermined location in the direction of passage.

If at least one roll stand is disposed downstream of the predetermined location in the direction of passage, it is possible for the roll stands disposed downstream of the predetermined location in the direction of passage to be raised so that their rollers do not come into contact with the flat rolling stock. Alternatively rollers of the corresponding roll stands can be lined up with the flat rolling stock so that they drive the flat rolling stock without shaping it.

If inter-stand cooling facilities are disposed upstream of the predetermined location in the direction of passage, they are alternatively active or inactive depending on the embodiment of the control method.

It is possible for the predetermined location to be located between the finishing train and the cooling section. The expected value for the energy content then replaces the measured temperature value. This can be advantageous for example when the expected value is enthalpy and the phase conversion from austenite to ferrite and cementite has already started upstream of the predetermined location. However the method shows its full advantage when at least one inter-stand cooling facility is disposed between the predetermined location and the last roll stand of the finishing train in the direction of passage. Then not only the cooling facilities of the cooling section but also the inter-stand cooling facilities of the finishing train disposed downstream of the predetermined location in the direction of passage are activated according to the determined energy content influences. The corresponding inter-stand cooling facilities are then considered as elements of the cooling section so to speak from the point of view of control.

The last "active" roll stand, in other words the last roll stand of the finishing train, in which the flat rolling stock is rolled, can be disposed within the finishing train if required. Generally the number of roll stands disposed downstream of the predetermined location in the direction of passage is between 1 and 3.

The target energy content progression from the predetermined location until the respective rolling stock point passes out of the cooling section can be determined as required. The target energy content progression is preferably determined in such a manner that at least the inter-stand cooling facility disposed directly downstream of the predetermined location is operated with at least 80% and/or with maximum 90% or 95% of its maximum possible energy content influence.

The final rolling thickness can be dimensioned as required. It is often between 5 mm and 30 mm.

A temperature measuring point is generally disposed between the finishing train and the cooling section, being used to measure the actual surface temperature of the rolling stock points at the location of the temperature measuring point. This temperature measuring point is therefore present in particular because "normal" rolling can also take place in the hot strip rolling line as an alternative to the mode of operation, in which case all the roll stands of the finishing train roll the flat rolling stock. In the context of such conventional procedures the surface temperature measured downstream of the finishing train can generally be used meaningfully, as described for example in DE 101 56 008 A1. In the context of the procedure however either the actual surface temperature of the rolling stock points at the location of the temperature measuring point is not measured or the actual surface temperature of the rolling stock points at the location of the temperature measuring point is measured but is not used to determine the target energy content progression.

It is possible to use the expected value determined for the predetermined location solely to determine the target energy content progression. Alternatively it is possible also to use the difference between a desired final rolling energy content and the energy content characterized by the expected value determined for the predetermined location to determine control variables for roll stands disposed upstream of the predetermined location and/or for inter-stand cooling facilities disposed upstream of the predetermined location.

The flat rolling stock rolled can be plate but it is preferably strip.

The energy content of the rolling stock points can alternatively be determined by their temperature or by their enthalpy, optionally plus the phase components of the respective rolling stock point.

The object is further achieved by a computer program which comprises machine code, which can be processed directly by a control computer for a hot strip rolling line for rolling flat rolling stock made of metal, its processing by the control computer causing the control computer to operate the hot strip rolling line according to such an operating method. The computer program is then embodied in such a manner that the control computer executes a control method for the proposed control method.

The object is further achieved by a control computer for a hot strip rolling line for rolling flat rolling stock made of metal, which is configured in such a manner that it executes such an operating method during operation.

The object is further achieved by a hot strip rolling line for rolling flat rolling stock for rolling flat rolling stock made of metal, wherein the hot strip rolling line comprises a finishing train for rolling the flat rolling stock, wherein the finishing train has a number of roll stands, through which the flat rolling stock passes in succession in a direction of passage, wherein the hot strip rolling line comprises a cooling section disposed downstream of the finishing train, wherein the hot strip rolling line is equipped with such a control computer, which hot strip rolling line is equipped with such a control computer.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
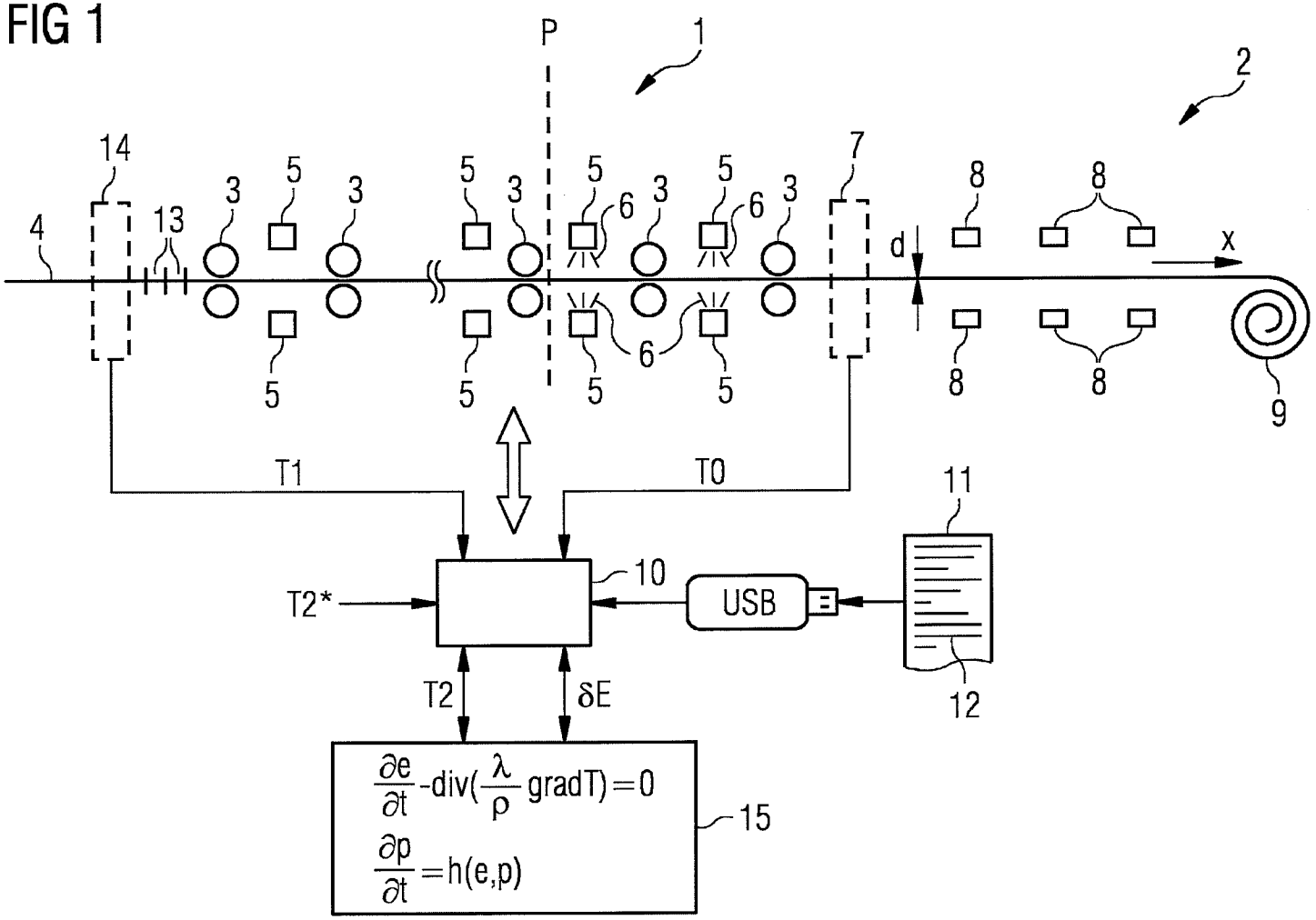
FIG. 1 shows a schematic diagram of a hot strip rolling line.

Reference will now be made in detail to the preferred embodiments of the present invention, examples of which are illustrated in the accompanying drawings, wherein like reference numerals refer to like elements throughout.

According to FIG. 1 a hot strip rolling line comprises at least one finishing train 1 and a cooling section 2. The cooling section 2 is disposed downstream of the finishing train 1. The finishing train 1 has a plurality of roll stands 3. Flat rolling stock 4 passes with an initial thickness and an initial energy into the frontmost roll stand 3 of the finishing train, passes in succession through the other roll stands 3 of the finishing train 1 and finally passes with a final rolling thickness d out of the last roll stand 3 of the finishing train 1. The flat rolling stock 4 therefore passes in succession through the roll stands 3 of the finishing train 1 in a direction of passage x that is the same for all the roll stands 3 (and also the cooling section 2).

The number of roll stands 3 can be determined as required. Generally minimum three roll stands 3 are present, maximum nine roll stands 3. Generally six or seven roll stands 3 are present.

Inter-stand cooling facilities 5 are preferably disposed at least between the rear roll stands 3, allowing the cooling of the flat rolling stock 4 with a cooling medium 6—generally water, a water/oil mixture or a water/air mixture. Alternatively or additionally inter-stand cooling facilities 5 can also be disposed between the front roll stands 3.

After the finishing train 1 the flat rolling stock 4 passes a temperature measuring point 7 and then passes into the cooling section 2. In the cooling section 2 the flat rolling stock 4 is cooled to a final energy content by cooling facilities 8 of the cooling section 2.

The flat rolling stock 4 is made of metal. The metal can be copper, aluminum, brass or another metal. The metal is often steel. The flat rolling stock 4 can—in particular if the metal is steel—alternatively be relatively short plate or much longer strip. In the case of strip, the flat rolling stock 4 is reeled into a coil 9 downstream of the cooling section 2.

The hot strip rolling line—in other words the unit comprising finishing train 1 and cooling section 2—is controlled by a control computer 10. The control computer 10 is programmed using a computer program 11. The computer program 11 can be supplied to the control computer 10 for example by way of a standard mobile data carrier, on which the computer program 11 is stored in machine-readable form.

The computer program 11 comprises machine code 12, which can be processed directly by the control computer 10. The processing of the machine code 12 by the control computer 10 causes the control computer 10 to control the hot strip rolling line according to a control method which is described in detail below with reference to FIG. 2. By being programmed using the computer program 11 the control computer 10 is configured in such a manner that it controls the hot strip rolling line accordingly.

The control method is described below with reference to FIG. 2 for an individual segment 13 of the flat rolling stock 4, hereafter referred to as the considered rolling stock point 13. However in practice the control method is executed in a parallel manner for all rolling stock points 13 present in the hot strip rolling line.

The rolling stock segments 13 or rolling stock points 13 can be defined as such as required. Generally the rolling stock points 13 are defined by a time cycle. In other words with every time cycle one rolling stock point 13 enters the hot strip rolling line and another rolling stock point 13 leaves the hot strip rolling line. The time cycle can be for example between 0.1 seconds and 1.0 seconds, in particular between 0.2 seconds and 0.5 seconds, preferably around approx. 0.3 seconds. Similarly the rolling stock points 13 can be defined for example by a predetermined length (for example 20 cm to 50 cm) or a predetermined mass (for example 20 kg to 50 kg) of the rolling stock 4 entering the hot strip rolling line.

Figure 2:
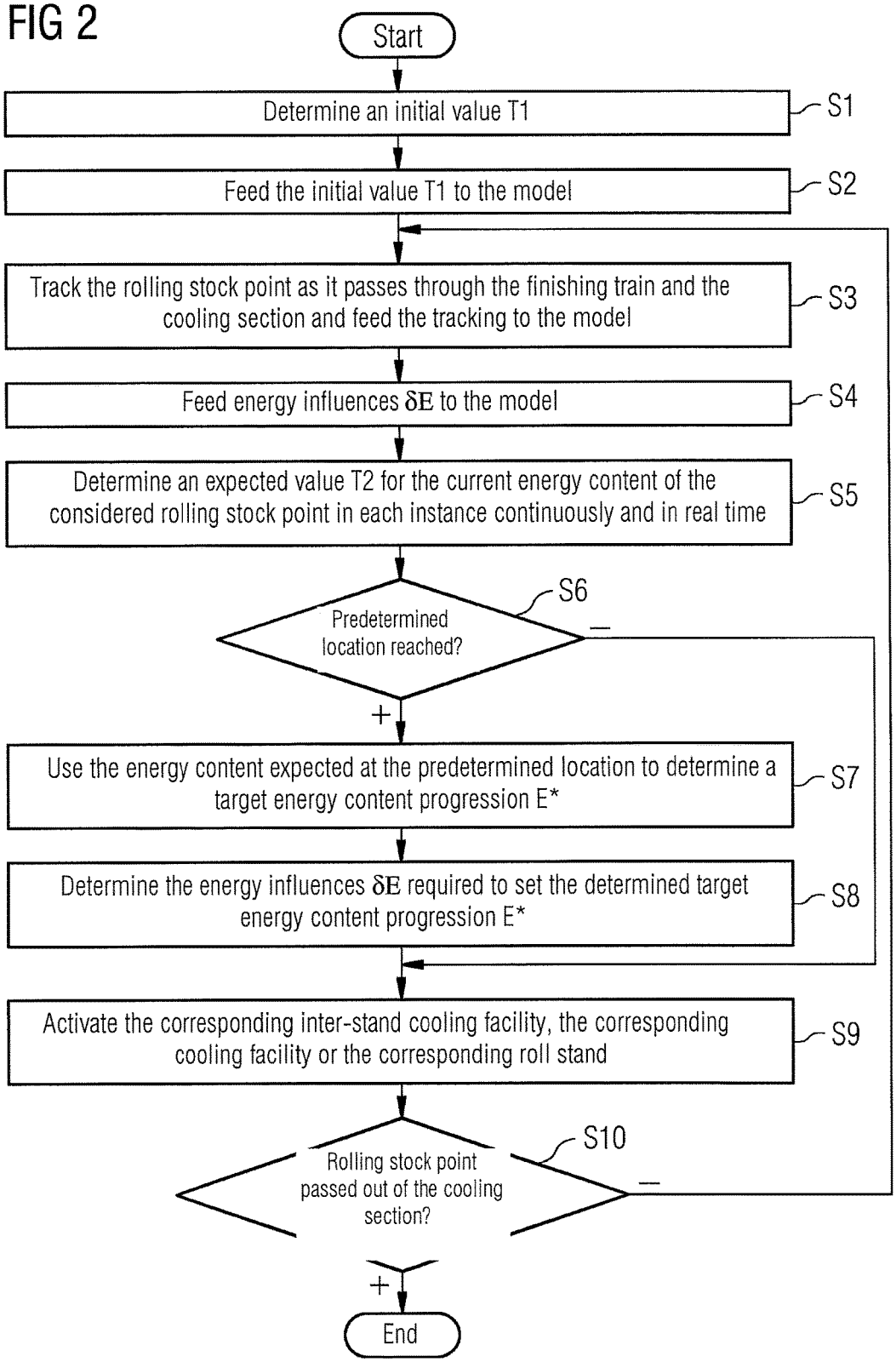
FIG. 2 shows a flow diagram.

According to FIG. 2 in S1 the control computer 10 determines an initial value T1 at the latest when the considered rolling stock point 13 enters the finishing train 1. The determined initial value T1 is characteristic of the energy content of the considered rolling stock point 13. In particular it can be the temperature or enthalpy of the considered rolling stock point 13. For example the actual temperature of the relevant rolling stock point 13 can be measured by a measuring device at a temperature measuring point 14 disposed upstream of the finishing train 1 and used directly as the initial value T1. It is also possible additionally to determine or presuppose the phase state of the considered rolling stock point 13 and thereby determine the enthalpy. For example in the case of steel with a (typically) measured temperature of approx. 1100° C. it can be automatically assumed that the rolling stock 4 is completely in the "austenite" phase. It is also possible for the initial value to be known by some other method, for example because it is made known to the control computer 10 by a higher-order or upstream control facility.

Subsequently the temperature or enthalpy can alternatively be used as the variable describing the energy content. Both variables can optionally be supplemented by phase components of the corresponding rolling stock point 13. Using the temperature has the advantage that it can be easily measured per se. Enthalpy has the advantage that it is a variable indicating energy and therefore also measures the latent energy of the phase conversions. It is up to the person skilled in the art which of the variables he/she uses. This and the consideration of any phase conversion in the context of the temperature determination are not explained in any more detail below, as such procedures and problems do not relate to the core of the proposed method etc. Rather the corresponding procedures and problems are common and known to the person skilled in the art.

As a result of the execution of the computer program 11 the control computer 10 implements a model 15 of the hot strip rolling line. The model 15 comprises mathematically physical equations, based on which it is possible gradually to determine a resulting new energy content in each instance or an expected value T2 characterizing the respective energy content for a given initial value T1 in conjunction with energy content influences δE. For example the model 15 can comprise a heat conduction equation and a phase conversion equation. The heat conduction equation can be the heat conduction equation known from DE 101 29 565 A1 for example and the phase conversion equation can be implemented according to the teaching of EP 1 711 868 B1. The control computer 10 feeds the determined initial value T1 to the model 15 in S2.

The considered rolling stock point 13 is also tracked by the control computer 10 in S3 as it passes through the finishing train 1 and the cooling section 2. For example the control computer 10 can receive rolling speeds from the roll stands 3 and determine the current speed of the considered rolling stock point 13 from the rolling speeds in conjunction with the (known) roller diameters and the—at least essentially—known forward and backward slip and thus update the respective position of the considered rolling stock point 13 from time cycle to time cycle. The control computer 10 also feeds the corresponding tracking to the model 15.

The considered rolling stock point 13 is subject to energy content influences δE in the finishing train 1 and the cooling section 2. An energy input results for example from the rolling—generally controlled by the control computer 10—in the roll stands 3 of the finishing train 1. An energy withdrawal also results—generally also controlled by the control computer 10—from the inter-stand cooling facilities 5 of the finishing train 1 and the cooling facilities 8 of the cooling section 2. Heat is also emitted into the atmosphere even without "active" temperature influence.

The energy influences δE are also fed to the model 15 by the control computer 10 in S4. The tracking of the considered rolling stock point 13 means that the control computer 10 knows whether and where applicable which roll stand 3 or whether and where applicable which inter-stand cooling facility 5 and whether and where applicable which cooling facility 8 of the cooling section 2 is currently acting on the considered rolling stock point 13. In S5 the control computer 10 therefore uses the model 15 to determine the current energy content of the considered rolling stock point 13 in each instance or the expected value T2 characteristic thereof continuously and in real time. The control computer 10 executes S5 as the considered rolling stock point 13 passes through the hot strip rolling line. The control computer 10 therefore continuously updates the respective expected value T2 based on the currently applicable energy content influence δE and the expected value T2 that was applicable directly beforehand. The control computer 10 determines which energy content influence δE should be used based on the tracking. This procedure allows the control computer 10 to update the expected value T2 step by step based on the initial value T1, so that the expected energy content of the relevant rolling stock point 13 is available at all times as the relevant rolling stock point 13 passes through the finishing train 1 and the cooling section 2.

The precise procedure for the current determination of the expected energy content is known per se to those skilled in the art. For the detailed embodiment, see the abovementioned DE 101 56 008 A1.

In S6 the control computer 10 checks whether the considered rolling stock point 13 has reached a predetermined location P. The predetermined location P is located between the first roll stand 3 and the first cooling facility 8 of the cooling section 2 in the direction of passage x. It is preferably located according to the diagram in FIG. 1 upstream of the last inter-stand cooling facility 5 of the finishing train 1. The fact that the inter-stand cooling facilities 5 are each disposed between two roll stands 3 and the temperature measuring point 7 is disposed downstream of the last roll stand 3 of the finishing train 1 means that in the embodiment in FIG. 1 the predetermined location P is (also) located upstream of the last roll stand 3 of the finishing train 1 and upstream of the temperature measuring point 7.

One, two or three roll stands 3 can be disposed for example between the predetermined location P and the temperature measuring point 7. This number can vary as required from flat rolling stock 4 to flat rolling stock 4 but not from considered rolling stock point 13 to considered rolling stock point 13 of the same flat rolling stock 4, as the predetermined location P is a location that is set purely by software. It can alternatively be predetermined in a fixed manner by the computer program 11 for example or can be predetermined externally for the control computer 10 or can even be determined by the control computer 10 based on other circumstances.

Once the considered rolling stock point 13 has reached the predetermined location P (and only then, not when the considered rolling stock point 13 is transported beyond the predetermined location P), the control computer 10 moves on to S7. In S7 the control computer 10 determines a target energy content progression E* for the considered rolling stock point 13. The target energy content progression E* extends from the predetermined location P until the considered rolling stock point 13 passes out of the cooling section 2. It can be defined for example as a spatial progression (in relation to the location of the considered rolling stock point 13 in the hot strip rolling line) or a temporal progression. The control computer 10 determines the target energy content progression E* in S7 using the expected value T2 for the energy content currently assigned to the considered rolling stock point 13, in other words at the predetermined location P. The control computer 10 therefore determines the target energy content progression E* using the energy content expected for the considered rolling stock point 13 at the predetermined location P.

From S7 the control computer 10 moves on to S8. In S8 the control computer 10 determines the energy influences δE that are required to set the energy content of the considered rolling stock point 13 according to the determined target energy content progression E*. Therefore in S8 the control computer 10 determines the energy influences δE, to which the considered rolling stock point 13 is subject from the predetermined location P until it passes out of the cooling section 2, as a function of the determined target energy content progression E*.

According to FIG. 2 the energy content influences δE for the considered rolling stock point 13 are determined immediately, in other words directly after the determination of the target energy content progression E*. Alternatively from S6, only S7 can simply be skipped in the NO branch. S8 can then be modified so that only the next energy content influence δE (or the next group of such influences δE) is determined for the considered rolling stock point 13. This allows later energy content influences δE for the considered rolling stock point 13 to be corrected subsequently after application of the corresponding influences δE to the considered rolling stock point 13.

In S9 the control computer 10 activates the corresponding inter-stand cooling facility 5, the corresponding cooling facility 5 of the cooling section 2 or the corresponding roll stand 3, depending on the location of the considered rolling stock point 13 in the hot strip rolling line.

Step S9 is executed always by the control computer 10, in other words both when the considered rolling stock point 13 is upstream of the predetermined location P and when the considered rolling stock point 13 is downstream of the predetermined location P. When the considered rolling stock point 13 is upstream of the predetermined location P, the corresponding energy influence δE is determined differently, for example as the considered rolling stock point 13 enters the finishing train 2 based on the initial value T1 for the energy content. However when the considered rolling stock point 13 is downstream of the predetermined location P, the energy influence δE determined in S8 is used. The inter-stand cooling facilities 5, which in the embodiment in FIG. 1 are disposed downstream of the predetermined location P in the direction of passage x, and the cooling facilities 8 of the cooling section 2 are therefore activated by the control computer 10 according to the energy content influences δE determined in S8. Generally, in other words when the predetermined location P is directly downstream of the finishing train 1 or between the last inter-stand cooling facility 5 and the last roll stand 3 of the finishing train 1 in the direction of passage x, only the cooling facilities 8 of the cooling section 2 are of course activated according to the energy content influences δE determined in S8.

It is possible for the inter-stand cooling facilities 5 located upstream of the predetermined location P—if such are present—to be activated. The influence of the corresponding inter-stand cooling facilities 5 on the energy content of the rolling stock points 13 must then be taken into account for the modeling. Alternatively these inter-stand cooling facilities 5 are inactive. The inter-stand cooling facilities 5 disposed upstream of the predetermined location P then do not cool the flat rolling stock 4.

In S10 the control computer 10 checks whether the considered rolling stock point 13 has passed out of the cooling section 2. If so, the procedure is terminated for the considered rolling stock point 13.

Preferred embodiments of the control method are described in more detail with reference to the further figures. The advantageous embodiments are described individually below. They can be combined as desired and without further ado.

Figure 3:
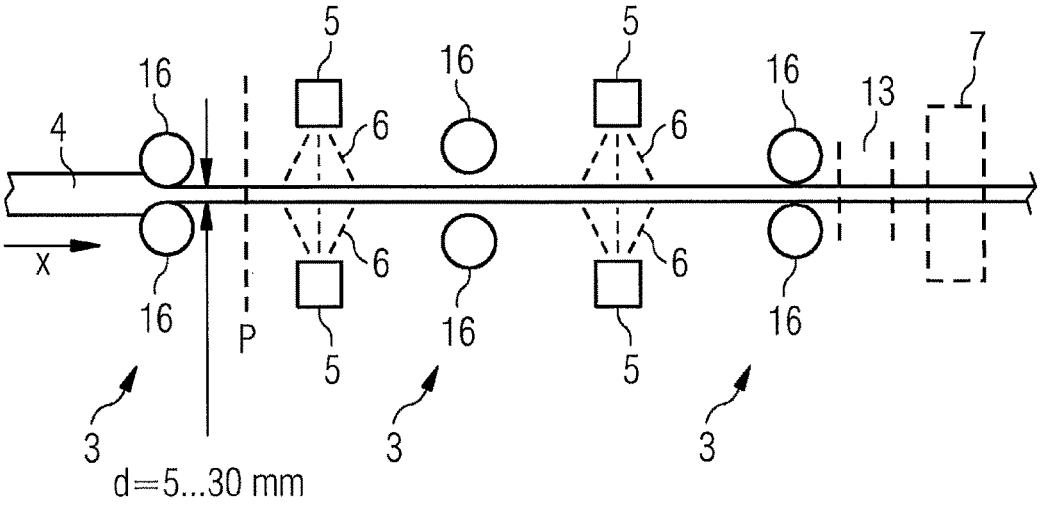
FIG. 3 shows a section of a finishing train.

According to FIG. 3 the flat rolling stock 4 is rolled to a final rolling thickness d in the roll stand 3 disposed directly upstream of the predetermined location P in the direction of passage x. The final rolling thickness d can be for example between 5 mm and 30 mm.

The flat rolling stock 4 is no longer rolled downstream of the predetermined location P. If roll stands 3 are disposed downstream of the predetermined location P, the flat rolling stock 4 is therefore no longer rolled there. The final rolling thickness d is maintained unchanged.

The downstream roll stands 3 can be raised so that their rollers 16 do not come into contact with the flat rolling stock 4. This is shown in FIG. 3 for the roll stand 3 disposed directly downstream of the predetermined location P. Alternatively it is possible for the rollers 16 of the downstream roll stands 3 to be brought into line with the flat rolling stock 4 but not to roll it, instead driving it without rolling it. This is shown in FIG. 3 for the last roll stand 3 of the finishing train 1.

Figure 4:
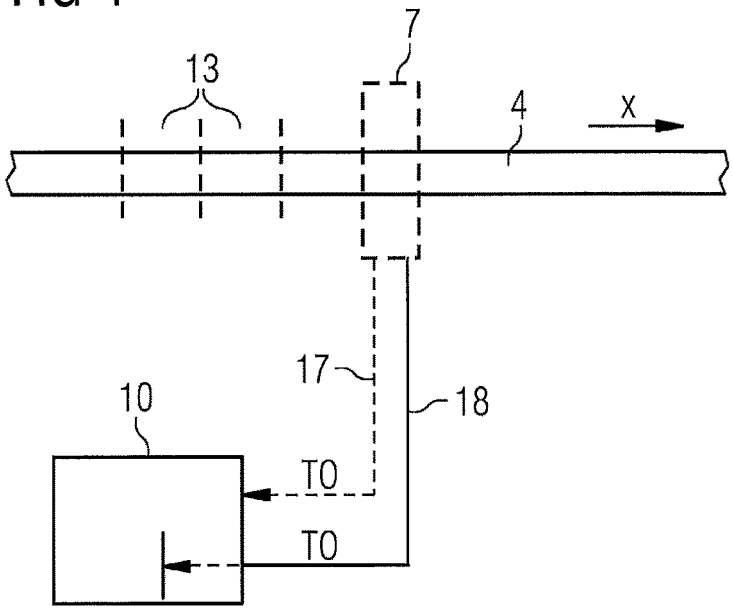
FIG. 4 shows a transition from a finishing train to a cooling section.

As already mentioned with reference to FIG. 1 and illustrated again in FIG. 4, a temperature measuring point 7 can be disposed between the finishing train and 1 and the cooling section 2, being used to measure the actual surface temperature TO of the rolling stock points 13 at the temperature measuring point 7. If the temperature measuring point 7 is present, various procedures are possible.

On the one hand it is possible for the corresponding surface temperatures TO not to be measured. This is shown in FIG. 4 by the broken line with the reference character 17. The temperature measuring point 7 is then present but not actively operated.

On the other hand it is possible for the corresponding surface temperatures TO to be measured and supplied to the control computer 10. This is shown in FIG. 4 by the solid line with the reference character 18. In this instance the surface temperature TO measured for a defined rolling stock point 13 is measured but not used to determine the target energy content progression E* of the considered rolling stock point 13. This is shown in FIG. 4 in that the line 18 is terminated with a line across it within the control computer 10. The measured surface temperature TO can however be used for other purposes in some circumstances, for example to adapt the model 15.

Figure 5:
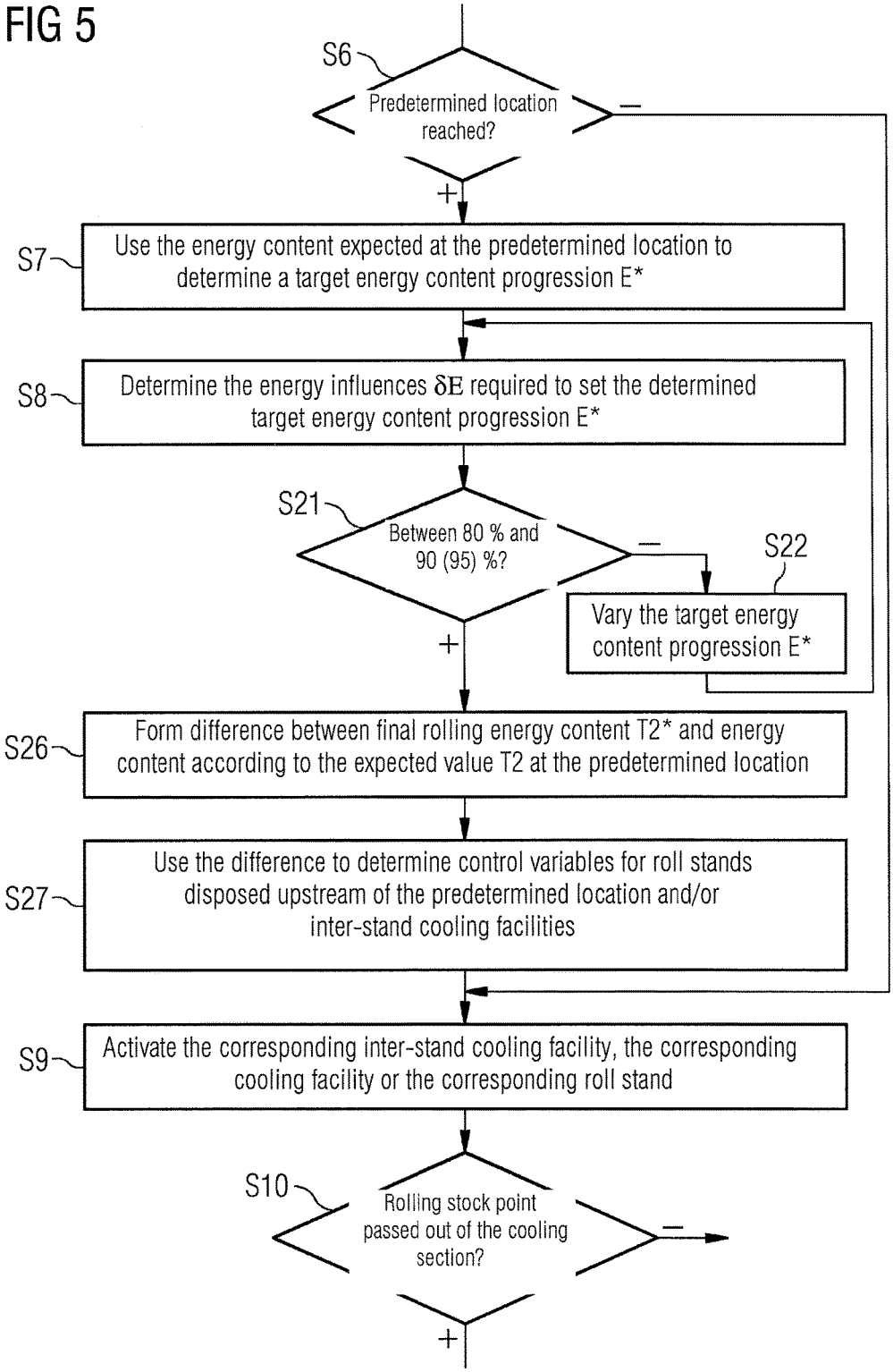
FIG. 5 shows a flow diagram.

FIG. 5 shows possible additions to S7 and S8 in FIG. 2.

According to FIG. 5 S8 is followed by S21. In S21 the control computer 10 checks whether the inter-stand cooling facility 5 disposed directly downstream of the predetermined location P is operated with at least 80% of its maximum possible energy content influence and/or with maximum 90% or maximum 95% of its maximum possible energy content influence in relation to the considered rolling stock point 13. If not, the control computer 10 moves on to S22 in the embodiment in FIG. 5. In S22 the control computer 10 varies the target energy content progression E* accordingly.

If further inter-stand cooling facilities 8 are disposed downstream of the predetermined location P, similar procedures are of course also possible for the further inter-stand cooling facilities 5.

Steps S26 and S27 can be present as alternatives or additions to S21 and S22. In S26 the control computer 10 forms the difference between a desired final rolling energy content T2* and the energy content according to the expected value T2, which is determined for the considered rolling stock point 13 at the predetermined location P. In S27 the control computer 10 uses this difference to determine control variables for roll stands 3 and/or inter-stand cooling facilities 5, which are disposed upstream of the predetermined location P. It is possible for example subsequently to adjust the energy content influences δE for inter-stand cooling facilities 5 disposed upstream of the predetermined location P according to an adjustment that is subject to dead time or to track a mass flow, which of course acts on the entire hot strip rolling line.

The proposals have multiple advantages. In particular the procedure allows tubular stock to be produced in a hot strip rolling line for both plate and strip.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in *Superguide* v. *DIRECTV,* 69 USPQ2d 1865 (Fed. Cir. 2004).

The invention claimed is:

1. A control method for a hot strip rolling line, the hot strip rolling line having a finishing train for rolling flat a rolling stock made of metal, the finishing train having a plurality of roll stands and cooling facilities, through which the rolling stock passes in succession in a direction of passage, the hot strip rolling line also having a cooling section through which the rolling stock passes, downstream of the finishing train, the method being executed by a control computer of the hot strip rolling line and comprising:

determining initial values, each initial value characterizing an energy content for a respective segment of the rolling stock at or before the respective segment enters the finishing train;

feeding the initial values to a model for the hot strip rolling line;

determining trackings by tracking each segment as the respective segment passes through the finishing train and the cooling section;

determining energy content influences by identifying how the energy content of each segment is influenced as the respective segment passes through the finishing train and the cooling section;

feeding the trackings and the energy content influences to the model;

determining an expected energy content value for each segment at a predetermined location between a first roll stand and the cooling section so as to continuously and in real time determine expected energy content values, the expected energy content values being determined using the model, the initial values, the trackings and the energy content influences;

determining a target energy content progression determined for the respective segment from the expected energy content value determined for the respective segment at the predetermined location for each segment from the predetermined location until the respective segment passes out of the cooling section, each energy content progression being determined using a corresponding expected energy content value;

producing manipulated influences by manipulating the energy content influences from the predetermined location until the respective segment passes out of the cooling section, as a function of the target energy content progression;

starting and stopping the cooling facilities of the finishing train or the cooling section in response to the manipulated influences by the control computer;

controlling the cooling of the respective segment of the rolling stock by the cooling facilities in response to the manipulated influences;

rolling the rolling stock to a final rolling thickness in a roll stand;

not rolling the rolling stock any more downstream of the roll stand; and disposing the predetermined location immediately downstream of the roll stand.

2. The control method as claimed in claim 1, further comprising:

disposing a number of roll stands downstream of the predetermined location in the direction of passage; and raising rollers of the number of roll stands under control of the control computer so that the rollers do not come into contact with the rolling stock, or lining the rollers up with the rolling stock under control of the control computer so that the rollers drive the rolling stock without rolling it.

3. The control method as claimed in claim 1, further comprising:

disposing inter-stand cooling facilities between the first roll stand and the predetermined location in the direction of passage, and controlling the inter-stand cooling facilities disposed upstream of the predetermined location by the control computer to be active or inactive.

4. The control method as claimed in claim 1, wherein a last roll stand of the finishing train in the direction of passage is adjacent to the cooling section, at least one inter-stand cooling facility is disposed between the predetermined location and the last roll stand of the finishing train, and the at least one inter-stand cooling facility disposed between the predetermined location and the last roll stand is activated by the control computer according to the energy content influences determined by the control computer.

5. The control method as claimed in claim 4, further comprising determining the predetermined location such that up to two additional roll stands are disposed between the predetermined location and the last roll stand.

6. The control method as claimed in claim 4, further comprising:

disposing the at least one inter-stand cooling facility directly downstream of the predetermined location; and determining the target energy content progression from the predetermined location until the respective rolling stock segment passes out of the cooling section in such a manner that the at least one inter-stand cooling facility is operated within a range of from 80% to 95% of its maximum possible energy content influence.

7. The control method as claimed in claim 4, further comprising:

disposing the at least one inter-stand cooling facility directly downstream of the predetermined location; and determining the target energy content progression from the predetermined location until the respective rolling stock segment passes out of the cooling section in such a manner that the inter-stand cooling facility is operated within a range of from 80% to 90% of its maximum possible energy content influence.

8. The control method as claimed in claim 4, further comprising rolling the rolling stock flat with the finishing train that under the control of the control computer to a final rolling thickness of between 5 mm and 30 mm.

9. The control method as claimed in claim 1, further comprising:

identifying a desired final rolling energy content by the control computer, determining an expected energy content value for the predetermined location by the control computer, determining a difference between the desired final rolling energy content and the expected energy content value for the predetermined location by the control computer, determining control variables for roll stands disposed upstream of the predetermined location and/or for inter-stand cooling facilities disposed upstream of the predetermined location by the control computer using the difference, and controlling the roll stands disposed upstream of the predetermined location or the inter-stand cooling facilities disposed upstream of the predetermined location by the control computer according to the determined control variables.

10. The control method as claimed in claim 1, wherein the initial values characterize the energy content based on respective temperatures or enthalpies of the rolling stock.

11. A non-transitory computer readable storage medium storing a computer program, which when executed by a computer causes the computer to perform a control method for a hot strip rolling line, the hot strip rolling line having a finishing train for rolling flat a rolling stock made of metal, the finishing train having a plurality of roll stands and cooling facilities, through which the rolling stock passes in succession in a direction of passage, the hot strip rolling line also having a cooling section through which the rolling stock passes, downstream of the finishing train, the method comprising:

determining initial values, each initial value characterizing an energy content for a respective segment of the rolling stock at or before the respective segment enters the finishing train;

feeding the initial values to a model for the hot strip rolling line;

determining trackings by tracking each segment as the respective segment passes through the finishing train and the cooling section;

determining energy content influences by identifying how the energy content of each segment is influenced as the respective segment passes through the finishing train and the cooling section;

feeding the trackings and the energy content influences to the model;

determining an expected energy content value for each segment at a predetermined location between a first roll stand and the cooling section so as to continuously and in real time determine expected energy content values, the expected energy content values being determined using the model, the initial values, the trackings and the energy content influences;

determining a target energy content progression determined for the respective segment from the expected energy content value determined for the respective segment at the predetermined location for each segment from the predetermined location until the respective segment passes out of the cooling section, each energy content progression being determined using a corresponding expected energy content value;

producing manipulated influences by manipulating the energy content influences from the predetermined location until the respective segment passes out of the cooling section, as a function of the target energy content progression;

starting and stopping the cooling facilities of the finishing train or the cooling section in response to the manipulated influences by the computer;

controlling the cooling of the respective segment of the rolling stock by the cooling facilities in response to the manipulated influences;

rolling the rolling stock to a final rolling thickness in a roll stand;

not rolling the rolling stock any more downstream of the roll stand; and disposing the predetermined location immediately downstream of the roll stand.

12. A hot strip rolling line comprising:

a finishing train to roll flat a rolling stock made of metal, the finishing train having a plurality of roll stands and cooling facilities, through which the rolling stock passes in succession in a direction of passage;

a cooling section through which the rolling stock passes, downstream of the finishing train a control computer having a processor to:

determine initial values, each initial value characterizing an energy content for a respective segment of the rolling stock at or before the respective segment enters the finishing train;

feed the initial values to a model for the hot strip rolling line;

determine trackings by tracking each segment as the respective segment passes through the finishing train and the cooling section;

determine energy content influences by identifying how the energy content of each segment is influenced as the respective segment passes through the finishing train and the cooling section;

feed the trackings and the energy content influences to the model;

determine an expected energy content value for each segment at a predetermined location between a first roll stand and the cooling section so as to continuously and in real time determine expected energy content values, the expected energy content values being determined using the model, the initial values, the trackings and the energy content influences;

determine a target energy content progression determined for the respective segment from the expected energy content value determined for the respective segment at the predetermined location for each segment from the predetermined location until the respective segment passes out of the cooling section, each energy content progression being determined using a corresponding expected energy content value;

produce manipulated influences by manipulating the energy content influences from the predetermined location until the respective segment passes out of the cooling section, as a function of the target energy content progression;

start and stop cooling facilities of the finishing train or the cooling section in response to the manipulated influences by the control computer;

controlling the cooling of the respective segment of the rolling stock by the cooling facilities in response to the manipulated influences;

rolling the rolling stock to a final rolling thickness in a roll stand;

not rolling the rolling stock any more downstream of the roll stand; and disposing the predetermined location immediately downstream of the roll stand.

* * * * *